United States Patent [19]

Tokita et al.

[11] Patent Number: 4,535,907

[45] Date of Patent: Aug. 20, 1985

[54] CATHODE-RAY TUBE

[75] Inventors: Kiyoshi Tokita, Fukaya; Toshinao Sone, Kumagaya; Michio Nakamura, Fukaya, all of Japan

[73] Assignee: Tokyo Shibaura Denki Kabushiki Kaisha, Tokyo, Japan

[21] Appl. No.: 586,147

[22] Filed: Mar. 5, 1984

[30] Foreign Application Priority Data

Mar. 9, 1983 [JP] Japan ..... 58-37435
Mar. 9, 1983 [JP] Japan ..... 58-37436

[51] Int. Cl.[3] ..... H01J 61/30

[52] U.S. Cl. ..... 220/2.1 A; 220/2.1 R; 313/477 R; 358/242

[58] Field of Search ..... 220/2.1 R, 2.1 A, 2.3 A; 313/477 R; 358/242, 243, 217, 250, 251, 252, 253

[56] References Cited

U.S. PATENT DOCUMENTS 3,089,052 5/1963 Bisbing ..... 220/2.1 A X
3,720,345 3/1973 Logue ..... 220/2.1 A
3,835,250 9/1974 Kaljuko et al. ..... 220/2.1 A X
3,839,002 10/1974 Verhoeven et al. ..... 220/2.1 A X
4,029,898 6/1977 Belentepe et al. ..... 220/2.3 A X
4,210,935 7/1980 Mitchell et al. ..... 220/2.1 A X

*Primary Examiner*—Steven M. Pollard
*Attorney, Agent, or Firm*—Cushman, Darby & Cushman

[57] ABSTRACT

A cathode-ray tube has a glass panel section which has a substantially rectangular faceplate and a skirt extending from the face plate along the tube axis, when Hs, Hl and Hd respectively denote the length of the skirt at the central portion of the short side, that at the central portion of the long side and that at the corner and ts, tl and td respectively represent the thickness of the faceplate in the vicinity of the center portion of the short side, that in the vicinity of the center portion of the long side and that in the vicinity of the corner the length of the skirt and the thickness of the faceplate respectively have relations defined by the following equations or inequalities (1) and (2):

$$Hs \geqq Hd \text{ and } Hl \geqq Hd \quad (1)$$

$$tl \geqq ts \text{ and } td \geqq ts \quad (2)$$

4 Claims, 9 Drawing Figures

FIG. 1 (PRIOR ART)
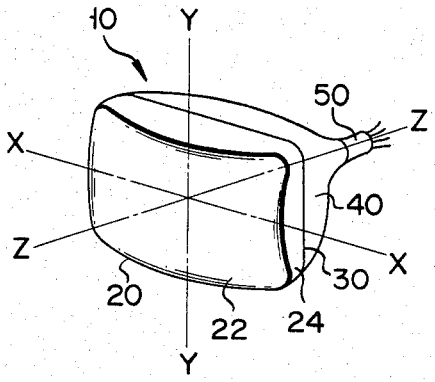
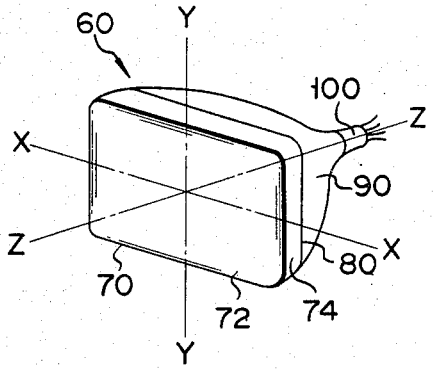
FIG. 3
FIG. 2A (PRIOR ART)
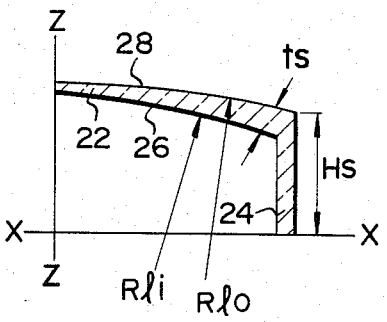
FIG. 2B (PRIOR ART)
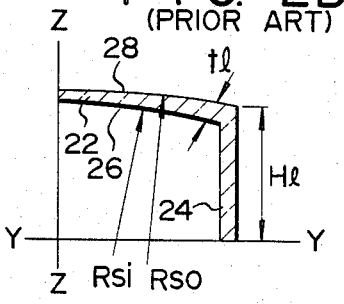
FIG. 2C (PRIOR ART)
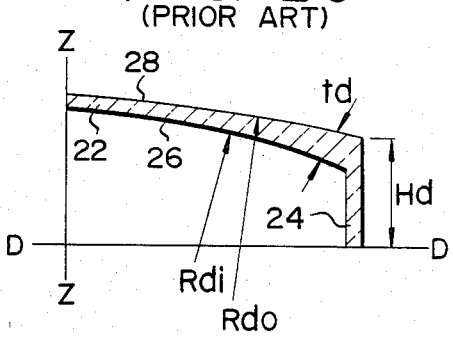

CATHODE-RAY TUBE

BACKGROUND OF THE INVENTION

The present invention relates to a cathode-ray tube and, more particularly, to a structure of a glass panel section of the cathode-ray tube.

In a conventional cathode-ray tube 10, as shown in FIG. 1, a phosphor screen is formed on the inner surface of a faceplate 22 of a glass panel section 20, the faceplate 22 having a substantially rectangular shape, and a funnel section 40 having a deflection yoke device (not shown) therearound is sealed to a skirt 24 of the glass panel section 20 through a connective portion 30. A neck 50 extends from the funnel section 40, and an electron gun (not shown) for emitting an electron beam is disposed in the neck 50. The envelope of the cathode-ray tube comprises the glass panel section 20, the funnel section 40 and the neck 50. The interior of the envelope is evacuated to a high vacuum pressure.

In the conventional cathode-ray tube of the type described above, the electron beam or electron beams from the electron gun is deflected in accordance with, for example, the NTSC system. In a color cathode-ray tube, the electron beams are landed on the phosphor screen through a plurality of apertures of a shadow mask opposing the inner surface of the faceplate 22. In order to decrease a difference between the length of a path of the electron beam emitted from the electron gun to the peripheral portion of the phosphor screen (i.e., the peripheral region of the inner surface of the faceplate 22) and the length of a path of the electron beam emitted from the electron gun to the central portion of the phosphor screen (i.e., the central region of the inner surface of the faceplate 22) and between deflection of the electron beam from the electron gun to the peripheral region of the phosphor screen and that of the electron beam from the electron gun to the central region thereof, the inner and outer surfaces of the rectangular faceplate 22 are curved outward with given radii of curvature. For example, as shown in FIGS. 2A to 2C, a longitudinal axis (X—X) shown in FIG. 1 is normal to the tube axis (Z—Z) and parallel to a line passing through center points of the short sides of the faceplate 22, a lateral axis (Y—Y) shown in FIG. 1 is normal to the tube axis (Z—Z) and parallel to a line passing through center points of the long sides of the face plate 22, and a diagonal axis (D—D) shown in FIG. 1 is normal to the tube axis (Z—Z) and parallel to a line passing through the diagonally opposite corners of the faceplate 22, if the inner surface radii of curvature along the lateral axis (Y—Y), the longitudinal axis (X—X) and the diagonal axis (D—D) of an inner surface 26 of the faceplate 22 are Rsi, Rli and Rdi, respectively, and the outer surface radii of curvature along the lateral, longitudinal and diagonal axes of the outer surface thereof are Rso, Rlo and Rdo, respectively, the faceplate 22 is generally designed and manufactured in a manner such that Rsi=Rli=Rdi=Ri and Rso=Rlo=Rdo=Ro, wherein Ri and Ro are predetermined values.

As shown in FIGS. 2A to 2C, when Hs, Hl and Hd respectively denote the length of the skirt 24 in the vicinity of the center portion of the short side, that in the vicinity of the center portion of the long side and that in the vicinity of the corner, each of the length being parallel to the tube axis (Z—Z), the length of each of three portions of the skirt 24 satisfies the inequality Hl>Hs>Hd when the outer surface radii of curvature are in the foregoing relations. As is also apparent from FIGS. 2A to 2C, when ts, tl and td respectively represent thickness of the faceplate 22 in the vicinity of the center portion of the short side, the center portion of the long side and the corner thereof, the thickness of each of three portions of the faceplate 22 satisfies the inequality tl>ts>td in accordance with the relations of distances between the tube axis and the center portion of the long side, between the tube axis and the center portion of the short side and between the tube axis and the corner, when the values Ri and Ro of the inner and outer surfaces radii of curvature are given as predetermined values, respectively, and the value Ri of the inner surface radii of curvature is equal to or smaller than the value Ro of the outer surface radii of curvature.

In the glass panel section 20 of this type, any stress acts on mechanically weak portions of the cathode-ray tube, so that implosion tends to occur. One of the mechanically weak portions in the connective portion 30 between the glass panel section 20 and the funnel section 40. In practice, an accidental impact acting on the outer surface 28 of the faceplate 22 is transmitted to the connective portion 30 through the skirt 24. In particular, the impact acting on the corner where the length of the skirt 24 is shortest remains substantially undamped, and is directly applied to the connective portion 30. The envelope having such a glass panel section tends to be vulnerable to implosion. The other of the mechanically weak portions is the center of the long side, at which the difference between the inner pressure of the envelope and the atmospheric pressure occurs. Since the thickness of each of three portions of faceplate 22 satisfies the inequality tl<ts<td, the thickness tl at the center portion of the long side is smaller than that at any other peripheral portion.

SUMMARY OF THE INVENTION

It is an object of the invention to provide a cathode-ray tube comprising a glass panel having greater mechanical strength than has been possible in the past.

According to the present invention, these is provided, a cathode-ray tube comprising a glass panel section constituting a glass envelope having a tube axis, said glass panel including a substantially rectangular faceplate whose inner and outer surfaces are curved, and a skirt extending from a peripheral portion of said faceplate along the tube axis, when ts, tl and td respectively denote thickness of the faceplate in the vicinity of the center portion of the short side, that in the vicinity of the center portion of the long side and that in the vicinity of the corner and Hs, Hl and Hd respectively represent length of the skirt at the center portion of the short side, that at the center portion of the long side and that at the corner as the length of each of them is measured between the outer surface of the faceplate and the end portion of the skirt along the tube axis, then, the thickness of the faceplate and the length of the skirt have relations defined by the following equations or inequalities (1) and (2):

$$Hs \geqq Hd \text{ and } Hl \geqq Hd \quad (1)$$

$$tl \geqq ts \text{ and } td \geqq ts \quad (2).$$

BRIEF DESCRIPTION OF THE DRAWINGS

FIG. 1 is a schematic perspective view of an envelope of a conventional cathode-ray tube;

FIGS. 2A to 2C are respectively schematic partial sectional views of the glass panel section taken along the longitudinal axis (X—X), the lateral axis (Y—Y) and the diagonal axis (D—D) in FIG. 1;

FIG. 3 is a schematic perspective view of an envelope of a cathode ray tube according to an embodiment of the present invention;

DETAILED DESCRIPTION OF THE PREFERRED EMBODIMENT

Figure 4A:
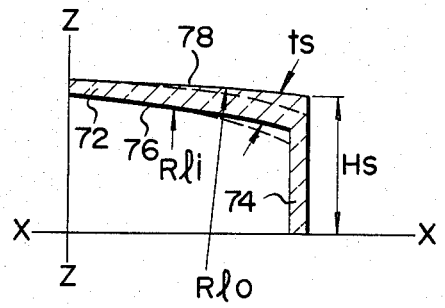
FIGS. 4A to 4C are respectively schematic partial sectional views of the glass panel taken along the longitudinal axis (X—X), the lateral axis (Y—Y) and the diagonal axis (D—D) in FIG. 3.

FIG. 3 shows a cathode-ray tube 60 according to an embodiment of the present invention. In this cathode-ray tube 60, a funnel section 90 hermetically sealed on a skirt 74 of the later described glass panel section 70 through a connecting portion 80, thereby forming an envelope. The envelope is evacuated to a high vacuum pressure. An electron gun for emitting an electron beam or electron beams is received in a neck 100 extending from the funnel section 90 along the tube axis (Z—Z). A deflection yoke device (not shown) for deflecting the electron beam is provided on the outer periphery of the funnel section 90. A phosphor screen (not shown) is formed on the inner surface of a faceplate 72 of the glass panel section 70 such that the phosphor screen emits light when the electron beam is landed on it. Furthermore, in the case of a color cathode-ray tube, a shadow mask (not shown) is disposed to the phosphor screen so as to pass the electron beams through a large number of apertures thereof.

As shown in FIG. 3, the glass panel section 70 has a longitudinal axis (X—X) which is normal to the tube axis (Z—Z) and parallel to a line passing through center points of the short sides of the faceplate 72, a lateral axis (Y—Y) which is normal to the tube axis (Z—Z) and parallel to a line passing through center points of the long sides of the faceplate 72, and a diagonal axis (D—D) which is normal to the tube axis (Z—Z) and parallel to a line passing through diagonally opposite corners of the faceplate 72.

Figure 4B:
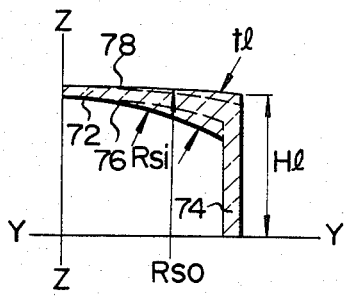
Figure 4C:
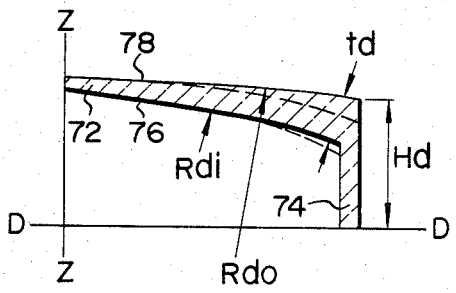

The glass panel section 70 of the cathode-ray tube 60 shown in FIG. 3 and FIGS. 4A to 4C involves the faceplate 72 which has a different shape from that of the conventional glass panel 20 shown in FIG. 1 and FIGS. 2A to 2C and whose thickness has a different distribution from the faceplate of the conventional glass panel section 20. As shown in FIGS. 4A to 4C, when Hs, Hl and Hd respectively denote the length of the skirt 74 in the vicinity of the center portion of the short side, that in the vicinity of the center portion of the long side and that in the vicinity of the corner as the length of each of them is measured along the tube axis (Z—Z) and ts, tl and td respectively represent the thickness of the faceplate 72 in the invincity of the center portion of the short side, the center portion of the long side and the corner, ts, tl and td respectively standing for the measurement values of the smallest dimensions of the edge of the effective screen, the length of the skirt 74 Hs, Hl and Hd and the thickness of the faceplate 72 ts, tl and td respectively have the relations expressed by the following equations or inequalities (1) and (2):

$$Hs \geqq Hd \text{ and } Hl \geqq Hd \quad (1)$$

$$tl \geqq ts \text{ and } td \geqq ts \quad (2).$$

Figure 5:
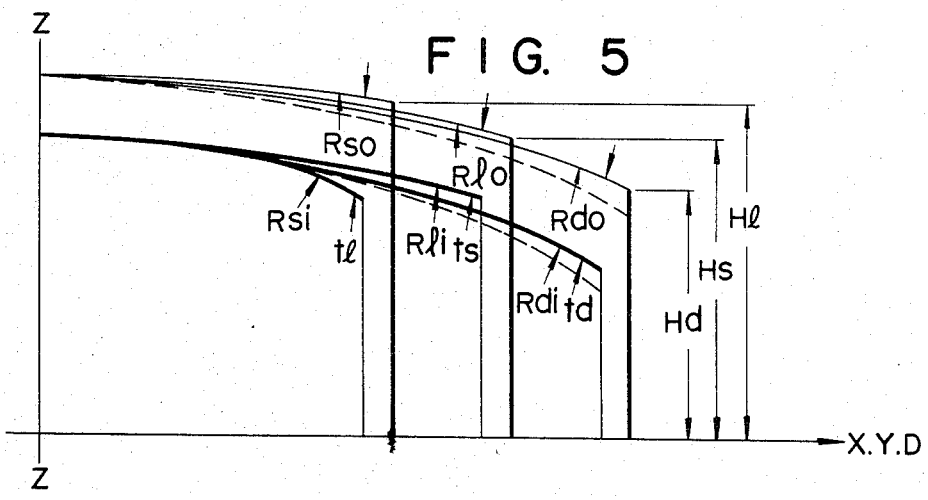
FIG. 5 is a typical diagram, showing the length of the skirt and the thickness of faceplate by superposing the respective sections of the glass panel section, indicated in FIGS. 4A to 4C.

The above relations are shown in FIG. 5, wherein the sectional views of the glass panel section 70 shown in FIGS. 4A to 4C are superposed on each other by way of comparison. The cross section of the faceplate 22 of the conventional one (FIGS. 2A to 2C) are set forth in a broken line in FIG. 5 alike in FIGS. 4A and 4B.

As shown in FIG. 5, in order to realize to above-mentioned relations of the length of the skirt 74 and the thickness of the faceplate 72 in the glass panel section 70 of the present invention, the inner and outer radii of curvature of the inner surface 76 and outer surface 78 of the faceplate 72 should have relations defined as follows;

$$Rso \geqq Rlo \geqq Rdo,\ Rsi \geqq Rli \text{ and } Rdi \geqq Rli.$$

In the above equations or inequalities, Rsi, Rli and Rdi respectively denote the inner radii of curvature along the lateral axis (Y—Y), the longitudinal axis (X—X) and the diagonal axis (D—D) shown in FIG. 3 of the inner surface 76 of the faceplate 72. Rso, Rlo and Rdo respectively represent the outer radii of curvature along the lateral axis (Y—Y), the longitudinal axis (X—X) and the diagonal axis (D—D) shown in FIG. 3 of the outer surfaces 78 of the faceplate 72.

The glass panel section of the cathode ray tube embodying this invention bearing the above-mentioned relations (FIG. 5) between the radii of curvature of the inner surface 76 and outer surface 78 of the glass panel section 70 has the advantages that said glass panel section is prominently increased in mechanical strength; particularly the center portions of the long sides of the glass panel, which undergo the greatest expansion stress caused by a difference between the atmospheric pressure and the internal pressure of the glass panel section 70, are noticeably increased in thickness; and the corner portions of the glass panel section, which are the shortest in length of the skirt 74 and transmit an external shock to the mechanically weakest connective portion 80, are considerably increased in thickness.

In other words, it is possible to provide the glass panel section 70 wherein the radii of curvature of the inner surface 76 and outer surface 78 of the faceplate 72 are enlarged, provided said glass panel section 70 meets the requirements for the aforementioned relations among three portions of the skirt 74 in length as well as among three portions of faceplate 72 in thickness.

The foregoing description of the inner and outer radii of curvature of the faceplate 72 refer to the case where the radii of curvature Rsi, Rli, Rdi, Rso, Rlo and Rdo were respectively assumed to have a single value as each radius of a simple curve. However, said radii of curvature Rsi, Rli, Rdi, Rso, Rlo and Rdo may have a compound value as each radius of a compound curve progressively varying from the central portion to the peripheral portion of the faceplate 72. The compound value of each radius of the compound curve may be given in a value of a progression. The inner and outer radii of curvature, Rsi, Rli, Rdi, Rso, Rlo and Rdo of the faceplate 72 respectively indicate different values along the lateral axis (X—X), the longitudinal axis (Y—Y) and the diagonal axis (D—D). However, it is possible to cause the different values of the respective radii of curvature to be smoothly connected, for example, by means of a progression, an average approximate quantity.

What is claimed is:

1. A cathode-ray tube comprising:

a glass panel section constituting a glass envelope having a tube axis, said glass panel section including a substantially rectangular faceplate, whose inner and outer surfaces are curved, and a skirt extending from a peripheral portion of said faceplate along the tube axis, wherein when ts, tl and td respectively denote thickness of said faceplate in the vicinity of the center portion of the short side, that in the vicinity of the center portion of the long side and that in the vicinity of the corner, and Hs, Hl and Hd respectively represent length of the skirt at the center portion of the short side, that at the center portion of the long side and that at the corner as the length of each of them is measured between the outer surface of said faceplate and the end portion of said skirt along the tube axis, then, the thickness of said faceplate and the length of said skirt have relations defined by the following equations of inequalities (1) and (2):

$$Hs \geqq Hd \text{ and } Hl \geqq Hd \quad (1),$$

$$tl \geqq ts \text{ and } td \geqq ts \quad (2).$$

2. A cathode-ray tube according to claim 1, wherein said inner surface being defined by a first inner surface radius of curvature Rsi set within a first plane including the tube axis and passing through center points of long sides of said faceplate, a second inner surface radius of curvature Rli set within a second plane including the tube axis and passing through center points of short sides of said faceplate, and a third inner surface radius of curvature Rdi set within a third plane including the tube axis and a diagonal line connecting a pair of diagonally opposite corners of said faceplate; and said outer surface being defined by a first outer surface radius of curvature Rso set within said first plane, a second outer surface radius of curvature Rlo set within said second plane and a third outer surface radius of curvature Rdo set within said third plane, said inner and outer surface radii of curvature have the relations defined by the following equations or inequalities (1) and (2):

$$Rso \geqq Rlo \geqq Rdo, \quad (1),$$

$$Rsi \geqq Rli \text{ and } Rdi \geqq Rli \quad (2).$$

3. A cathode-ray tube according to claim 2, wherein said inner surface radii of curvature Rsi, Rli and Rdo and said outer surface radii of curvature Rso, Rlo and Rdo respectively forms a simple curve or a compound curve.

4. A cathode-ray tube according to claim 3, wherein said outer surface radii of curvature Rso, Rlo and Rdo are larger than or equal to said inner surface radii of curvature Rsi, Rli and Rdi, respectively.

* * * * *

UNITED STATES PATENT AND TRADEMARK OFFICE

CERTIFICATE OF CORRECTION

PATENT NO. : 4,535,907

DATED : August 20, 1985

INVENTOR(S) : Kiyoshi Tokita, Toshinao Sone and Michio Nakamura

It is certified that error appears in the above-identified patent and that said Letters Patent is hereby corrected as shown below:

It is certified that an error appears in the address of the Assignee and said Letters Patent are hereby corrected as shown below:

[73] Assignee: Tokyo Shibaura Denki Kabushiki Kaisha, Kawasaki-shi, Japan

Signed and Sealed this

*Tenth* Day of *June 1986*

[SEAL]

*Attest:*

DONALD J. QUIGG

*Attesting Officer*

*Commissioner of Patents and Trademarks*

US004535907B1

REEXAMINATION CERTIFICATE (3455th)

United States Patent [19] [11] B1 4,535,907

Tokita et al. [45] Certificate Issued Mar. 10, 1998

[54] CATHODE-RAY TUBE

[75] Inventors: Kiyoshi Tokita, Fukaya; Toshinao Sone, Kumagaya; Michio Nakamura, Fukaya, all of Japan

[73] Assignee: Tokyo Shibaura Denki Kabushiki Kaisha, Kawasaki, Japan

Reexamination Request:
No. 90/004,181, Mar. 13, 1996

Reexamination Certificate for:

| | |
|---|---|
| Patent No.: | **4,535,907** |
| Issued: | **Aug. 20, 1985** |
| Appl. No.: | **586,147** |
| Filed: | **Mar. 5, 1984** |

Certificate of Correction issued Jun. 10, 1986.

[30] Foreign Application Priority Data

Mar. 9, 1983 [JP] Japan ..... 58-37435
Mar. 9, 1983 [JP] Japan ..... 58-37436

[51] Int. Cl.[6] ..... H01J 61/30

[52] U.S. Cl. ..... 220/2.1 A; 220/2.1 R; 313/477 R

[58] Field of Search ..... 220/2.1 R, 2.1 A; 313/477 R

[56] References Cited

U.S. PATENT DOCUMENTS

| | | | |
|---|---|---|---|
| 3,089,052 | 5/1963 | Bisbing | 220/2.1 A X |
| 3,720,345 | 3/1973 | Logue | 220/2.1 A |
| 3,835,250 | 9/1974 | Kaljuko et al. | 220/2.1 A X |
| 3,839,002 | 10/1974 | Verhoeven et al. | 220/2.1 A X |
| 3,931,906 | 1/1976 | Bradu . | |
| 4,029,898 | 6/1977 | Belentepe et al. | 220/2.3 A X |
| 4,210,935 | 7/1980 | Mitchell et al. | 220/2.1 A X |
| 4,839,556 | 6/1989 | Ragland, Jr. . | |

FOREIGN PATENT DOCUMENTS

| | | |
|---|---|---|
| 54-35754 | 11/1974 | Japan . |
| 52-144654 | 8/1977 | Japan . |
| 52-137764 | 10/1977 | Japan . |
| 54-97360 | 8/1979 | Japan . |
| 55-28270 | 2/1980 | Japan . |
| 57-103239 | 6/1982 | Japan . |
| 58-16444 | 1/1983 | Japan . |

*Primary Examiner*—Steven M. Pollard

[57] ABSTRACT

A cathode-ray tube has a glass panel section which has a substantially rectangular faceplate and a skirt extending from the face plate along the tube axis, when Hs, Hl and Hd respectively denote the length of the skirt at the central portion of the short side, that at the central portion of the long side and that at the corner and ts, tl and td respectively represent the thickness of the faceplate in the vicinity of the center portion of the short side, that in the vicinity of the center portion of the long side and that in the vicinity of the corner the length of the skirt and the thickness of the faceplate respectively have relations defined by the following equations or inequalities (1) and (2):

$$Hs \geqq Hd \text{ and } Hl \geqq Hd \quad (1)$$

$$tl \geqq ts \text{ and } td \geqq ts \quad (2)$$

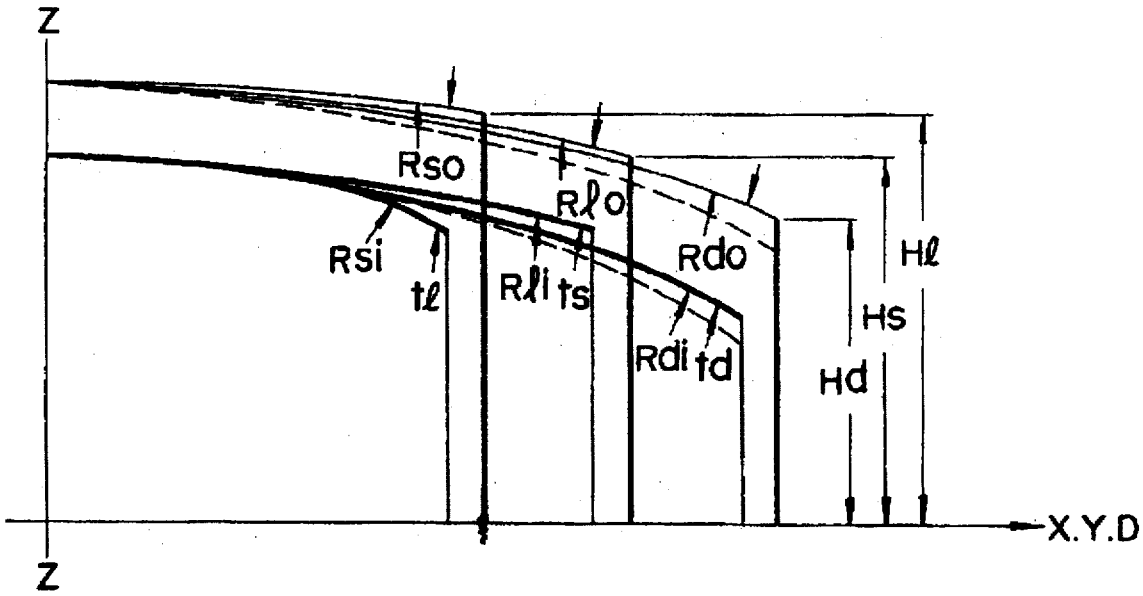

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, line 11–line 19:

As shown in FIG. 5, in order to realize to above-mentioned relations of the length of the skirt 74 and the thickness of the faceplate 72 in the glass panel section 70 of the present invention, the inner and outer radii of curvature of the inner surface 76 and outer surface 78 of the faceplate 72 should have relations defined as follows:

[Rso≧Rlo≧Rdo, Rsi≧Rli and Rdi≧Rli]*Rso≧Rlo≧Rdo, Rsi≦Rli and Rdi≦Rli.*

AS A RESULT OF REEXAMINATION, IT HAS BEEN DETERMINED THAT:

Claims 1–3 are determined to be patentable as amended.

Claim 4, dependent on an amended claim, is determined to be patentable.

New claim 5 is added and determined to be patentable.

1. A cathode-ray tube comprising:

a glass panel section constituting a glass envelope having a tube axis, said glass panel section including a substantially rectangular faceplate, whose inner and outer surfaces are curved *and non-spherical*, and a skirt extending from a peripheral portion of said faceplate along the tube axis, wherein when ts, tl and td respectively denote thickness of said faceplate in the vicinity of the center portion of the short side, that in the vicinity of the center portion of the long side and that in the vicinity of the corner, and Hs, Hl and Hd respectively represent length of the skirt at the center portion of the short side, that at the center portion of the long side and that at the corner as the length of each of them is measured between the outer surface of said faceplate and the end portion of said skirt along the tube axis, then, the thicknes of said faceplate and the length of said skirt have relations defined by the following equations of inequalities (1) and (2):

$$H_s H_d \text{ and } H_l \leqq H_d \quad (1),$$

$$t_l \leqq t_s \text{ and } t_d \leqq t_s \quad (2).$$

2. A cathode-ray tube [according to claim 1,] *comprising:*

*a glass panel section constituting a glass envelope having a tube axis, said glass panel section including a substantially rectangular faceplate, whose inner and outer surfaces are curved and non-spherical, and a skirt extending from a peripheral portion of said faceplate along the tube axis, wherein when ts, tl and td respectively denote thickness of said faceplate in the vicinity of the center portion of the short side, that in the vicinity of the center portion of the long side and that in the vicinity of the corner, and Hs, Hl and Hd respectively represent length of the skirt at the center portion of the short side, that at the center portion of the long side and that at the corner as the length of each of them is measured between the outer surface of said faceplate and the end portion of said skirt along the tube axis, then, the thickness of said faceplate and the length of said skirt have relations defined by the following equations or inequalities (1) and (2);*

$$Hs \geqq Hd \text{ and } Hl \geqq Hd \quad (1),$$

$$tl \geqq ts \text{ and } td \geqq ts \quad (2),$$

wherein said inner surface being defined by a first inner surface radius of curvature Rsi set within a first plane including the tube axis and passing through center points of long sides of said faceplate, a second inner surface radius of curvature Rli set within a second plane including the tube axis and passing through center points of short sides of said faceplate, and a third inner surface radius of curvature Rdi set within a third plane including the tube axis and a diagonal line connecting a pair of diagonally opposite corners of said faceplate; and said outer surface being defined by a first outer surface radius of curvature Rso set within said first plane, a second outer surface radius of curvature Rlo set within said second plane and a third outer surface radius of curvature Rdo set within said third plane, said inner and outer surface radii of curvature have the relations defined by the following equations or inequalities (1) and (2):

$$Rso \geqq Rlo \geqq Rdo, \quad ([1]^3),$$

$$[Rsi \geqq Rli \text{ and } Rdi \geqq Rli]\ Rsi \leqq Rli \text{ and } Rdi \leqq Rli \quad ([2]^4).$$

3. A cathode-ray tube according to claim 2, wherein said inner surface radii of curvature Rsi, Rli and [Rdo] *Rdi* and said outer surface radii of curvature Rso, Rlo and Rdo respectively [forms] *form* a simple curve or a compound curve.

*5. A cathode-ray tube according to claim 1 or claim 2, wherein said inner surface radii of curvature Rsi, Rli and Rdi or said outer surface radii of curvature Rso, Rlo and Rdo respectively form a simple curve or a compound curve.*

* * * * *